United States Patent [19]

Tsuruoka

[11] Patent Number: 4,711,561

[45] Date of Patent: Dec. 8, 1987

[54] TONER RECOVERY DEVICE

[75] Inventor: Ryoichi Tsuruoka, Hongo Ebina, Japan

[73] Assignee: Rank Xerox Limited, London, England

[21] Appl. No.: 919,732

[22] Filed: Oct. 16, 1986

[30] Foreign Application Priority Data

Oct. 21, 1985 [JP] Japan ..... 60-233411

[51] Int. Cl.[4] ..... G03G 15/00; G03G 21/00

[52] U.S. Cl. ..... 355/3 R; 355/15; 355/3 DD; 118/652

[58] Field of Search ..... 355/15, 3 DD, 14 DD, 355/3 R; 118/652, 691; 222/DIG. 1

[56] References Cited

U.S. PATENT DOCUMENTS 3,838,472 10/1974 Oriel ..... 355/15 X
4,251,155 2/1981 Schnall et al. ..... 355/15
4,436,414 3/1984 Kamiyama et al. ..... 355/15

FOREIGN PATENT DOCUMENTS 1302922 1/1973 United Kingdom .
2100436 12/1982 United Kingdom .

*Primary Examiner*—R. L. Moses

[57] ABSTRACT

A toner fill sensor for a toner recovery device with a recovery box into which residual toner is scraped from the latent image carrying member with a cleaning means, has a window comprising a transparent or translucent housing projecting upwardly through said recovery box; an optical sensor having a light emitting and receiving elements arranged across said projected housing; a flat float member vertically movable on top of the toner recovered in the recovery box; and a light shielding flag erected on said float member at the position corresponding to the projected housing so that as the level of toner recovered rises, the light shield of the float member blocks the light path of the optical sensor, providing a toner fill signal.

16 Claims, 9 Drawing Figures

TONER RECOVERY DEVICE

BACKGROUND OF THE INVENTION

The present invention relates to electrostatographic printing apparatus and more particularly to a toner recovery device for recovering the residual toner on the latent image carrying member of such apparatus. More specifically, the present invention provides an indication of the quantity of toner recovered in the recovery device preferably with the use of optical sensors.

In an electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in that art as toner. Most development system employ a developer material which comprises both charged carrier particles and charged toner particles which triboelectrically adhere to the carrier particles. During development the toner particles are attracted from the carrier particles by the charge pattern of the image areas in the photoconductive insualting area to form a powder image on the photoconductive area. This image may subsequently be transferred to a support surface such as copy paper to which it may be permanently affixed by heating or by the application of pressure.

Many commerical applications of the above process employ a modular concept for the various processing stations. For example, the imaging member, developer assembly and cleaner asssembly may be combined in a single unit or cartridge which has a limited life at the end of which it may be discarded and replaced with a new unit or cartridge. Alternatively, a charging device may be added to the unit or the unit may contain either of the developer or the cleaner.

PRIOR ART

U.S. Pat. No. 3,985,436 (Tanaka et al.) describes a copying apparatus in which an imagining member, developing device and cleaner may be incorporated in a casing as one unit to be releasably inserted into the main apparatus housing.

U.S. Pat. No. 4,470,689 (Nomura et al.) also describes such a unit which is provided with a movable protection cover for protecting the image bearing member and illustrates in FIGS. 15A–15F several different alternative of process elements which may be included in such a process unit.

U.S. Pat. No. 4,551,000 (Kanemitsu) also illustrates a process kit which includes in addition to the imaging member, the developer and the cleaner. This process kit is also provided with appartus for indicating when the useful life of the process kit is about to expire and when it has expired.

U.S. Pat. No. 4,501,484 (Shimura) discloses a toner cleaning and residual toner collecting apparatus which includes a photoelectric sensor with a light emitting element and a light receiving element adapted to sense the level of collected toner in the container and when the cleaned toner container is filled up with collected toner that condition is displayed on a panel by an output signal of the sensor.

FIG. 8 shows a toner recovery device that has been used wherein residual toner is scraped from a photosensitive drum 1 into a toner receiver 3 by means of a cleaning blade 2. The toner is then transported to a toner recovery box 5 by means of a rotary conveyor member 4. when the toner recovery box 5 is filled with recovered toner, it must be replaced and therefore it is necessary to detect without failure when the recovery box is filled with toner. To accomplish this, the conventional toner recovery box 5 has been designed to have an outer box 5*a* and an inner box 5*b*. The toner from the toner receiver 3 is housed in the inner box 5*b*, which is supported within the outer box 5*a* by a spring 6. A switch 7 is provided between the outer and inner boxes 5*a* and 5*b* for sensing whether the inner box is filled with toner. Since the inner box 5*b* is lowered according to the weight of toner recovered, the switch 7 will operate at a predetermined position to generate a signal indicating that the inner box is filled with toner.

The device suffers from the difficulty that the inner box 5*b* of this toner recovery device needs spaces above and below itself for its vertical movement thereby making the device larger and less desirable for use in a compact copier. In addition, some of the recovered toner can adhere to the electrical switch 7, causing poor contact of the switch, leading to a malfunction. An alternative to this structure and one which is similar to that illustrated in U.S. Pat. No. 4,501,484 described above is shown in FIG. 9. A transparent or translucent housing 11 is secured to the ceiling of the toner recovery box 5 so that its central portion is projected upward through an opening 10 in the top of the toner recovery box 5. An optical sensor 12 consisting of a light emitting element 12*a* and light receiving element 12*b* is placed across the projected housing 11. As toner fills the toner recovery box 5 and the projected housing 11, it blocks the light path of optical sensor 12, changing the output of the sensor, indicating that the toner recovery box is filled with toner.

However, if the power of conveyor member 4 is insufficient to push the recovered toner up to the projected housing 11, the detection of a toner fill condition will be unreliable. Moreover, some of the recovered toner filling the recovery box can leak through seals of the box or may become airborne as a result of the conveyor action. If floating toner deposits on the projected housing either inside or outside the housing the toner deposition will block the light path of sensor 12. Consequently, the sensitivity of sensor 12 must be adjusted so as to compensate for the blockage by the deposited toner which is a troublesome operation. Furthermore, the toner recovery box 5 usually extends in the axial direction of photosensitive drum 1 and the distribution of toner recovered in the box 5 can be polarized in the axial direction having peak areas and low areas. If the peak of toner recovered corresponds to the projected housing 11 and blocks the light path of sensor 12, the entire recovery box 5 may be mistaken to be filled with toner when it is not. To solve this problem a number of optical sensors 12 and projected portions of cover 11 may be provided along the length of toner recovery box 5. However this requires the use and assembly of more parts resuling in higher manufacturing cost.

SUMMARY OF THE INVENTION

In a principle aspect of the invention, a toner recovering device for recovering residual toner from an imaginign bearing member comprises a toner recovery box haing a transparent or translucent window in its upper portion and a float member vertically movable to float on top of toner recovered having a flag member on top at a position corresponding to the window so that as the level of toner increases the float member rises correspondingly and the flag may be viewed in the window providing an indication of the amount of toner recovered in the toner recovery box.

In a further principle aspect of the invention, the window comprises a housing projecting upwardly through the top of the recovery box and at least one optical sensor having light emitting and recieving elements arranged across the projected housing to provide a signal when the light path is blocked by a lifht shielding flag member indicating the amount of toner recovered in the toner recovery box including whent he recovery box is substantially full.

In a further aspect of the present invention, the light shielding flag member has a plurality of step portions and a plurality of optical sensors corresponding to sa id step portions to provide a plurality of signals indicating a plurality of conditions of the amount of toner recovered.

In a further aspect of the present invention, the float member is suspended from the top of of the recovery box by at least one flexible sheet.

In a further aspect of the present invention, the recovery device includes a cleaning assembly and an image bearing member mounted in cooperative association with each other to provide a processing unit.

In a further aspect of the present invention, the signals generated by the optical sensor provide a display of the condition of the amount of toner recovered.

In a further aspect of the invention an inexpensive toner fill sensor for a toner recovery device for sensing a toner fill condition of the recovery box without failure regardless of the state of a toner distribution within the box is provided.

DESCRIPTION OF PREFERRED EMBODIMENTS

According to the invention there is provided at toner fill sensor for a toner recovery device with a recovery box into which residual toner is scraped from the latent image carrying member with a cleaning means, which has a window comprising a transparent or translucent housing projecting upwardly through said recovery box; an optical sensor having a light emitting and receiving elements arranged across said projected housing; a flat float member vertically movable on top of the toner recovered in the recovery box; and a light shielding flag erected on said float member at the position corresponding to the projected housing so that as the level of toner recovered rises, the light shield of the float member blocks the light path of the optical sensor, providing a toner fill signal.

The toner recovery device may be either separated from or united with a cleaning device and a latent image carrying member. The shape and positioning of the toner recovery box may be modified as long as a toner inlet is provided at the lower portion of the toner box so as to assure vertical movement of the float member as the amount of recovered toner increases. The material of the projected housing may be any transparent or translucent resin. The shape and positioning of the projected housing may be modified as needed. The material and size of the float member may be modified, but a light material is desirable becuase it must be pushed up by the rising toner surface. The size may be sufficiently large to offset the polarization of a toner distribution, but it is preferred that it is substantially equal to the shape and area of a horizontal section of the recovery box. The supports for the float member may be any means for supporting it above the toner inlet so that the float member may rise along with the rising level of toner. Preferably, the supports for the float member are flexible shields which also perform a sealing function together with the physical barrier presented by the float member for preventing airborne toner from getting on top of the float member, and depositing on the projected housing and block the light path of the optical sensor under the toner fill condition.

According to the invention, as the level of toner recovered rises and finally reaches the toner fill condition, the light shield enters the projected housing and blocks the light path of the optical sensor, providing a toner fill signal. Even if the toner distribution is polarized lengthwise or widthwise in the box, the float member although slightly inclined, is lifted as a whole and blocks the light path at a point substantially corresponding to the toner fill condition. When the level of a toner fill signal is set at an absolute zero, meaning zero light is received by the light detector, there is little or no possibility that the optical sensor makes an error providing a toner fill signal because of the presence of some toner adhering to the projected housing.

Figure 1:
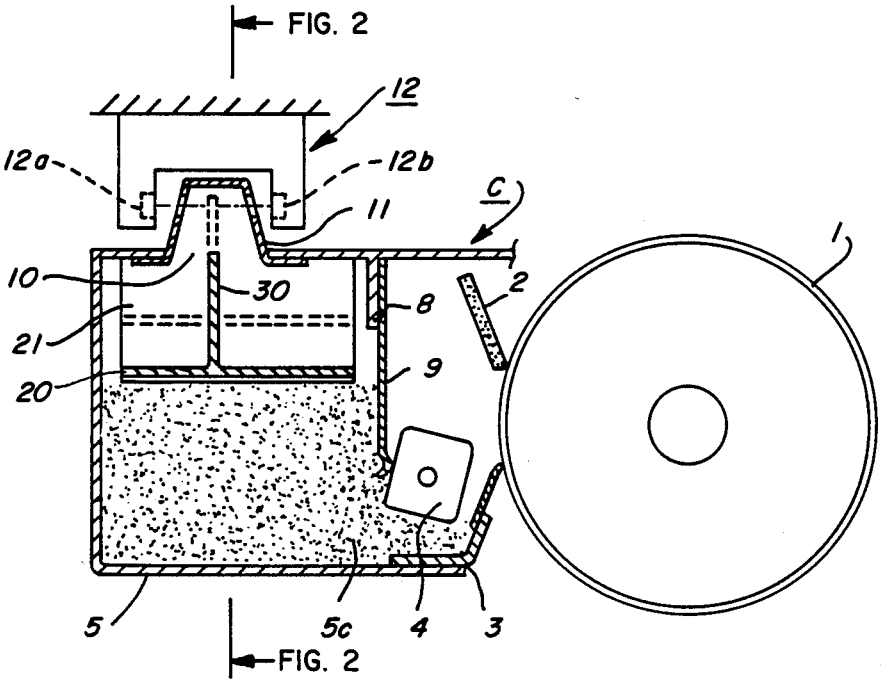
FIG. 1 is a sectional view of a toner-fill sensor embodying the present invention.
Figure 2:
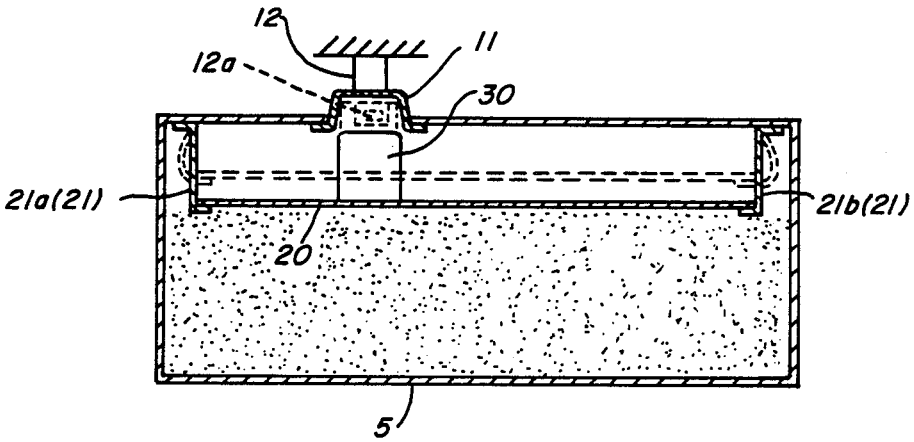
FIG. 2 is a sectional view taken along the line II—II of FIG. 1.
Figure 3:
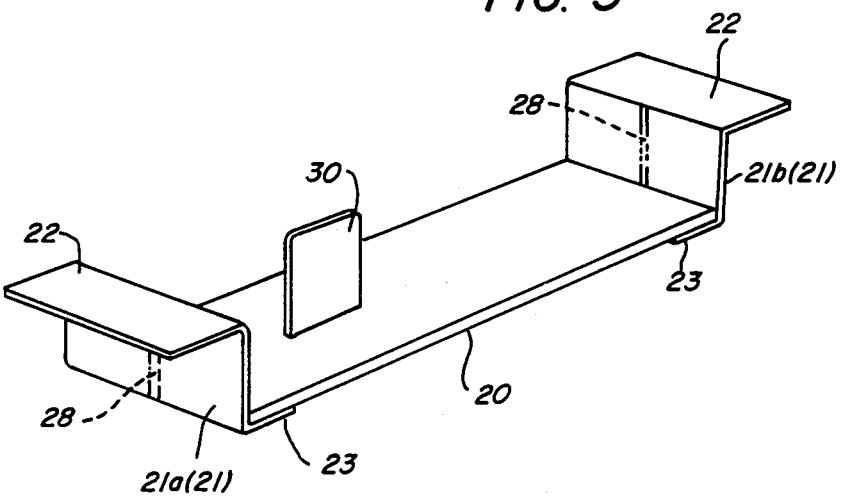
FIG. 3 is a perspective view of the float member and its supports of the toner fill sensor.

Referring now to FIGS. 1, 2 and 3, there is shown in cross section a toner recovery device constituting a unit along with a rotatable photosensitive drum 1, a cleaning blade 2, a toner receiving member 3, and a toner conveyor member 4. The toner receiving member 3 is secured to the toner inlet 5*c* of a toner recovery box 5. The photosensitive drum 1, cleanind blade 2, and toner conveyor member 4 are all mounted to the unit case C. The toner conveyor member 4 with a rectangular cross section is placed at the toner inlet 5*c* for rotation in contact with the toner receiving member 3. A partition 8 extends downaward from the ceiling of unit case C to define the toner recovery box 5. A toner scraper 9 is secured to the partition 8 at the end for scraping off the toner adhering to the conveyor member 4.

The toner sensor consists of a trasnparent or translucent housing 11 secured to the ceiling of recovery box 5 so as to project upward through an opening 10, an optical sensor 12 having a light emitting element 12*a* and a light receiving member 12*b* arranged across the projected housing 11, a float member 20 vertically movable within the recovery box 5, and a light shield 30 erected on the float member 20. The preferred float member 20 is made of ABS resin in the form of a rectangular plate with a size substantially equal to the shape and area of a horizontal section of the recovery box 5. This float is suspended from the ceiling of recovery box 5 with a pair of flexible sheets 21 (21*a* and 21*b*) for vertical movement. The preferred support sheet 21 is made of a polyethylene terephthalate or polypropylene film 25 to 50 microns thick and has bent portions 22 and 23 secured to the ceiling of recovery box 5 and the float 20, respectively, with double-sided adhesive tape or the like. The preferred light shield 30 may be made of ABS resin or other black opaque material, and its height is set so that when toner fills evenly the recovery box, the shielding piece 30 blocks the light path of optical sensor 12.

In operation, as shown in FIGS. 1 and 2, the residual toner is scraped off the photosensitive drum 1 into the toner receiver 3 by the cleaning blade 2. The toner is then transported to and collected in the recovery box 5 by means of the conveyor member 4. The level of toner recovered in the box rises according to the amount of use and reaches the bottom of float 20 in a certain time. As the toner level further rises, the float 20 also rises along with the rising toner level as shown with broken lines in FIGS. 1 and 2 and stops rising when the box is filled with toner. At this point, the light shield 30 of float 20 enters the projeced housing 11, blocking the light path of optical sensor 12. The output of optical sensor 12 changes from its high to low, indicating that the box is filled with toner which condition is displayed on the copier control panel by an output signal of the sensor 12.

Figure 4:
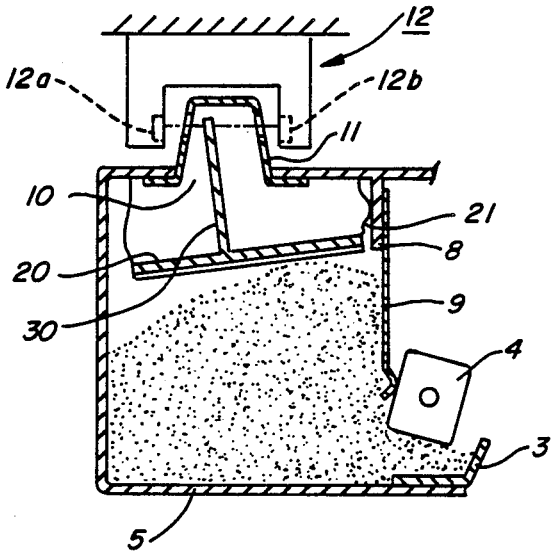
FIGS. 4 and 5 illustrate how the toner-fill sensor works when the surface of toner recovered is inclined.
Figure 5:
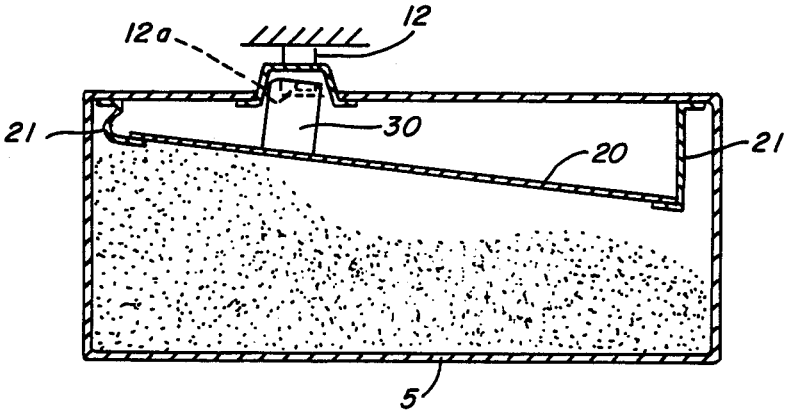

As FIGS. 4 and 5 show, when the distribution of toner recovered is polarized in lengthwise or widthwise in the recovery box 5, the float 20 may be inclined according to the toner distribution, but the light shield 30 will still be able to block the light path of optical sensor 12. When the toner-fill signal of optical sensor 12 is set at an absolute zero, there is no possibility that the optical sensor 12 makes an error, providing a toner fill signal because of the presence of the adhering toner on the projected housing. When the amount of toner filling the box is set to be equal to the life span of photosensitive drum 1, the toner fill signal may be used for a unit replacement display. In this case, the toner recovery device, cleaning device, and photosensitive drum do not have to be inspected and maintained one by one, thus making the maintenance of the copier simpler.

The width of float 20 is so close to the width of recovery box 5 that little toner may get on the float through the gaps between the float and the box, assuring stable rise of the float and containment of toner. The flexible sheets 21 suspending the float 20 at the longitudinal ends also serve as a seal for preventing the recovered toner from getting on the float. Consequently, even if the length of float 20 is made a little smaller than that of recovery box 5, the recovered toner is prevented from getting on the float through the longitudinal ends. If such flexible sheets are also applied to the sides of float 20, the sealing quality of float 20 is enhanced in this case, even if the width of float 20 is made a little smaller than that of recovery box 5, the recovered toner is prevented from getting on the float through the sides. In the illustrated embodiment, the flexible sheet 21 is so thin that there is some difficulty in handling it in the assembling operation of the float 20. As shown with broken lines in FIG. 3, a cut 28 is provided in the 50-micron thick polyethylene terephthalate or polypropylene film 21, making the suspension of the float 20 easier and giving the flexible sheet 21 a sufficient margin to deform.

Figure 6:
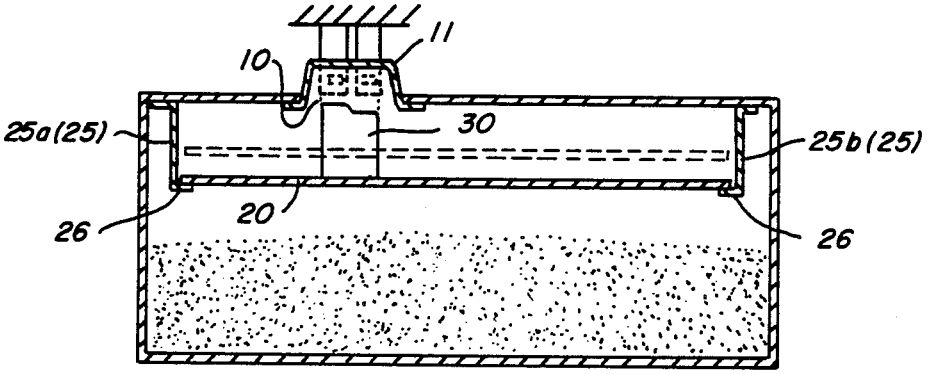
FIGS. 6 and 7 are sectional view of alternative embodiments of the invention.

In the alternative embodiment of FIG. 6, a pair of support pieces 25 (25*a* and 25*b*) of synthetic resin or the like are secured to the ceiling of recovery box 5 so as to extend downward, with their free ends bent inward to form a pair of bent portions 26 for supporting the float 20. As the level of recovered toner rises, only the float plate 20 rises together with the rising toner level along the support pieces 25. When the toner fills the box, the light shield 30 of float 20 blocks the light path of optical sensor 12, producing a toner-fill signal.

In addition, FIG. 6 illustrates the use of a plurality of optical sensors 12 in operative association with a plurality of step portions on the light shielding flag member to provide a plurality of signals indicating a plurality of conditions of the amount of toner recovered. While only two step portions and sensors are indicated it will be understood that any number could be used. The two portions could, for example, provide an indication when blocking their respective light paths of a partly full, one half, condition and a completely full recovery box condition.

Figure 7:
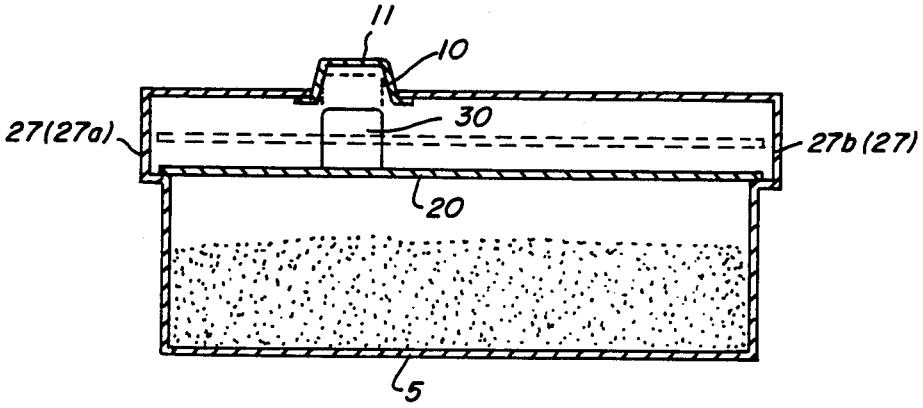
Figure 8:
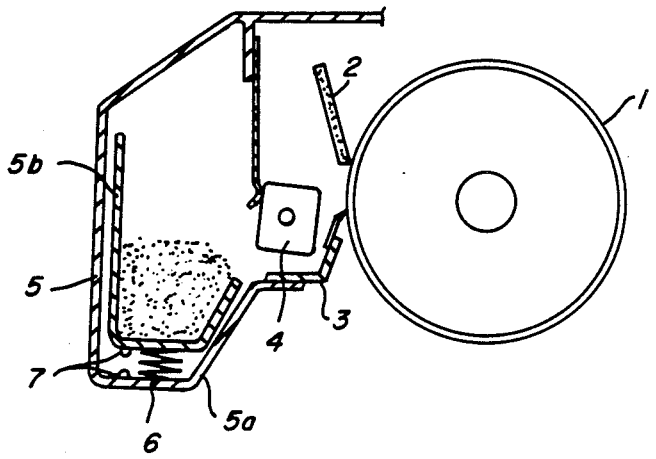
FIGS. 8 and 9 are sectional vies of two types of prior art devices.
Figure 9:
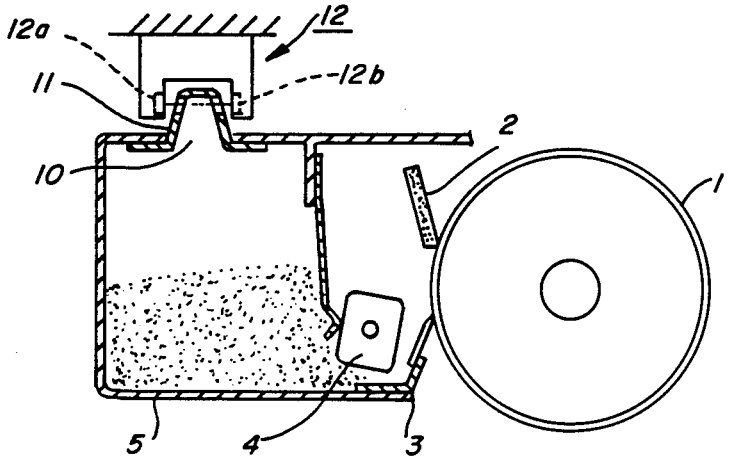

In FIG. 7, on opposite sides of recovery box 5 there are provided widthwise a pair of shoulders 27 (27*a* and 27*b*), on which the float 20 is placed. Since this float also rises together with the rising toner level, a toner fill condition may be sensed in the same way as described above.

Thus according to the present invention one is able to sense a toner fill condition regardless of variations in the distribution of toner recovered in the box or the contamination of the optical sensor with toner. Only a flat float member is added to the conventional toner recovery device, minimizing the additional manufacturing cost.

The disclosure of the patents referred to herein are hereby specifically and totally incorporated herein by reference.

While the invention has been described with reference to specific embodiment, it will be apparent to those skilled in the art that many alternatives, modifications and variations may be made. Accordingly, it is intended to embrace all such alternatives and modifications that may fall within the spirit and scope of the appended claims.

What is claimed is:

1. A toner recovering device for recovering residual toner from an image bearing member comprising a toner recovering box adapted for containing recovered toner therein and having a transparent or translucent window at the upper portion thereof, said recovery box containing a float member vertically movable to float on top of toner recovered in said recovery box inr esponse to the amount of toner recovered in said recovery box, said float member having fixed to its top a flag member at a position corresponding to said window so that as the level of toner increases said float member rises corresponding to the quantity of recovered toner and said flag member may be viewed in said window providing an indication of the amount of toner recovered in the toner recovery box.

2. The toner recovery device of claim 1, wherein said window comprises a housing projecting upwardly through the top of said recovery box.

3. The toner recovery device of claim 2, further including at least one optical sensor having light emitting and receiving elements arranged across said projected housing and wherein said flag member is a light shield which blocks the light path between said light emitting and receiving elements when said float member rises in said housing in response to increased quantity of recovered toner to provide a signal indicating the amount of toner recovered in the toner recovery box.

4. The toner recovery device of claim 3, wherein the light shield blocks the light path when said toner recovery box is substantially full.

5. The toner recovery device of claim 3, wherein said light shielding flag member has a plurality of step portions and including a plurality of optical sensors corresponding to said step portions for providing a plurality of signals indicating a plurality of conditions of the amount of toner recovered.

6. The toner recovery device of claim 1, wherein said float member is suspended from the top of said recovery box by at least one pair of flexible sheets, one on each side of the float.

7. The toner recovery device of claim 6, wherein said flexible sheet is a 25 to 50 micron thick film of polypropylene or polyethylene terephthalate.

8. The toner recovery device of claim 1, including a cleaning assembly for removing residual toner from an image bearing member.

9. The toner recovery device of claim 8, further including an image bearing member and means to mount said image bearing member in cooperative association with said cleaning assembly and toner recovery box to provide a processing unit.

10. The toner recovery device of claim 3, including a cleaning assembly for removing residual toner from an image bearing member.

11. The toner recovery device of claim 10, further including an image bearing member and means to mount said image bearing member in cooperative association with said cleaning assembly and toner recovery box to provide a processing unit.

12. The toner recovery device of claim 3, further including means in response to said signal to provide a display of the amount of toner recovered in the toner recovery box.

13. The toner recovery device of claim 4, further including means in response to said signal to provide a display of the condition that the toner recovery box is substantially full.

14. The toner recovery device of claim 5, further including means in response to said plurality of signals to provide a display of the plurality of conditions of the amount of toner recovered.

15. The toner recovery device of claim 3, wherein the float member is substantially equal to the shape and area of a horizontal section of the recovery box.

16. The toner recovery device of claim 6, wherein said float member is suspended from the top of said recovery box by flexible sheet extending along the length of each side of said float member.

* * * * *